United States Patent [19]

Knowlton et al.

[11] Patent Number: 4,604,151

[45] Date of Patent: Aug. 5, 1986

[54] METHOD AND COMPOSITIONS FOR GENERATING NITROGEN GAS

[75] Inventors: Gregory D. Knowlton, Chandler; John F. Pietz, Mesa, both of Ariz.

[73] Assignee: Talley Defense Systems, Inc., Mesa, Ariz.

[21] Appl. No.: 696,285

[22] Filed: Jan. 30, 1985

[51] Int. Cl.[4] ..... C06B 35/00

[52] U.S. Cl. ..... 149/35; 149/76; 252/188.1; 252/188.25; 252/188.31; 280/736; 280/741; 422/164

[58] Field of Search ..... 149/35, 76; 422/164; 280/736, 741; 252/188.25, 188.1, 188.31

[56] References Cited

U.S. PATENT DOCUMENTS

| | | | |
|---|---|---|---|
| 3,715,131 | 2/1973 | Hurley et al. | 280/150 |
| 3,741,585 | 6/1973 | Hendrickson et al. | 149/35 |
| 3,755,182 | 8/1973 | Marshall | 252/188.3 |
| 3,773,947 | 11/1973 | Boyars et al. | 423/351 |
| 3,779,823 | 12/1973 | Price et al. | 149/19 |
| 3,785,674 | 1/1974 | Poole et al. | 280/150 |
| 3,805,098 | 7/1974 | Pietz | 149/35 |
| 3,814,694 | 6/1974 | Klager | 252/186 |
| 3,865,660 | 2/1975 | Lundstrom | 149/35 |
| 3,883,373 | 5/1975 | Sidebottom | 149/35 |
| 3,901,747 | 8/1975 | Garner | 149/42 |
| 3,904,221 | 9/1975 | Shiki et al. | 102/531 |
| 3,912,561 | 10/1975 | Doin et al. | 149/35 |
| 3,920,575 | 11/1975 | Shiki et al. | 149/35 X |
| 3,931,040 | 1/1976 | Breazeale | 252/188.3 |
| 3,947,300 | 3/1976 | Passauer et al. | 149/35 |
| 3,996,079 | 12/1976 | DiValentin | 149/35 |
| 4,021,275 | 5/1977 | Kishi et al. | 149/35 |
| 4,062,708 | 12/1977 | Goetz | 149/35 |
| 4,066,415 | 1/1978 | Kasama et al. | 102/531 |
| 4,157,648 | 6/1979 | Brennan et al. | 149/35 |
| 4,203,787 | 5/1980 | Kirchoff et al. | 149/35 |
| 4,244,758 | 1/1981 | Garner et al. | 149/7 |
| 4,296,084 | 10/1981 | Adams et al. | 423/351 |
| 4,297,331 | 10/1981 | Sermon | 423/239 |
| 4,339,288 | 7/1982 | Camp | 149/35 X |
| 4,376,002 | 3/1983 | Utracki | 149/35 |
| 4,390,380 | 6/1983 | Camp | 149/35 X |

FOREIGN PATENT DOCUMENTS

| | | |
|---|---|---|
| 1417022 | 12/1975 | United Kingdom . |

*Primary Examiner*—Stephen J. Lechert, Jr.
*Attorney, Agent, or Firm*—Pennie & Edmonds

[57] ABSTRACT

A gas generating composition is disclosed for generating nitrogen gas free from noxious and toxic impurities consisting of an alkali metal azide, at least a stoichiometric amount of a metal oxide or a mixture of metal oxides and an ammonium perchlorate burn rate enhancer. The nitrogen gas can be used to inflate an impact protection air cushion of an automotive restraint system.

27 Claims, 1 Drawing Figure

METHOD AND COMPOSITIONS FOR GENERATING NITROGEN GAS

FIELD OF THE INVENTION

The invention relates generally to a gas generating composition that utilizes the combustion of a solid gas generating composition to achieve a rapid generation of a nitrogen gas that is free of noxious and toxic impurities. The composition is particularly useful for rapidly filling an inflatable cushion vehicle restraint system for the protection of the occupants of a vehicle from severe impact and possible injury during a collision.

BACKGROUND OF THE INVENTION

The use of protective gas-inflated bags to cushion vehicle occupants in crash situations is now widely known and well documented. In earlier systems of this type, a quantity of compressed, stored gas was employed to inflate a crash bag which, when inflated, was positioned between the occupant and the windshield, steering wheel and dashboard of the vehicle. The compressed gas was released by rapid impact responsive to actuators or sensors which sense a rapid change in velocity of the vehicle as in an accident situation.

Because of the bulk of this apparatus, its generally slow reaction time and its maintenance difficulties, stored gas systems have largely been superseded by systems that utilize a gas generated by a chemical gas generating substance or composition. These systems involve the use of an ignitable propellant system for inflating the air cushion, wherein the inflating gas is generated by the exothermic reaction of the reactants forming the propellant composition. The bags used in a restraint system of this type must be inflated to a sufficient degree in a very short time span, generally on the order of tens of milliseconds, to accomplish their purpose. In addition, the gas should meet several rather stringent requirements. It should be nontoxic and nonnoxious. The temperature of the gas as generated should be low enough so as not to burn the bag, undermine its mechanical strength, or burn the passengers in the vehicle in the event the bag ruptures.

The industry has been striving to develop a gas generating composition which combines the essential features of short induction period, a burn rate which is rapid but without explosive effects, a high bulk density so that only a small amount of the composition is required to produce a large amount of gas and the production of only nontoxic and non-noxious gases.

RELATED ART

Several issued patents relate to various methods and compositions for generating nitrogen gas which is nontoxic and nonexplosive and can be generated in large amounts from a relatively small quantity of chemicals. U.S. Pat. No. 3,912,561 to Doin et al. relates to a fuel pyrotechnic composition consisting of an alkali metal azide or alkaline earth azide, an alkali metal oxidant and an nitrogeneous compound such as an amide or tetrazole, and silica as an optional additive.

U.S. Pat. No. 4,021,275 to Kishi et al. relates to a gas generating agent for inflating air bags. The agent is produced by the co-precipitation of at least one alkali metal or alkaline earth metal azide and at least one alkali metal or alkaline earth metal nitrate or perchlorate, preferably in the presence of silicon dioxide or glass powder.

U.S. Pat. No. 4,157,648 to Brennan et al. relates to a method in which nitrogen gas is generated from an alkali metal azide with certain metal halides. The halides are added to prevent the formation of free alkali metal.

U.S. Pat. No. 3,741,585 to Hendrickson et al. relates to a low temperature nitrogen gas generating composition containing metal azides and reactants such as metallic sulfides, metal oxides, and sulfur.

U.S. Pat. No. 3,883,373 to Sidebottom relates to a gas generating composition consisting of an alkali or alkaline earth metal azide, an oxidizing compound such as a peroxide, perchlorate, or nitrate, an oxide such as silica or alumina and optionally a metal such as silicon or aluminum.

U.S. Pat. No. 3,901,747 to Garner relates to a pyrotechnic composition combined with a binder-coolant. The fuel is described as a carbonaceous material, aluminum or magnesium. The patent lists several suitable inorganic oxidizers such as perchlorates.

U.S. Pat. No. 3,895,098 to Pietz discloses a gas generating composition in which the reactants are alkali metal azides and a metal oxide. The patent also discloses mixtures of iron, titanium, and copper oxides.

U.S. Pat. No. 4,376,002 to Utracki discloses a nitrogen gas generating composition consisting of a mixture of one or more alkali metal azides or alkaline earth azides and an oxidant consisting of more than one metal oxide.

SUMMARY OF THE INVENTION

The solid nitrogen gas generating propellants of this invention are suitable for use in many applications including automotive passive restraint systems. In the passive restraint application highly pure, inert, nontoxic nitrogen gas is rapidly generated and utilized to inflate an air bag which serves as a cushion to protect vehicle occupants upon sudden deceleration.

The gas generating compositions of this invention comprise an alkali metal azide, preferably sodium azide, a metal oxide selected from the oxides of iron, nickel, manganese, copper, cobalt, titanium and tin, and ammonium perchlorate as a burn rate enhancer. The azide is a major component and is present in an amount of from 55 to 85% by weight of the composition, preferably 60 to 70% by weight of the composition, and is also the primary nitrogen gas producing compound in the propellant. The metal oxide is the principal oxidizing reactant for the azide and is present as 10 to 45 weight percent, preferably 25 to 35 weight percent of the composition. The ammonium perchlorate which acts as a burn rate enhancer is present as from 1 to 15%, preferably 1 to 8%, by weight of the composition. In addition to acting as a burn rate enhancer, the ammonium perchlorate also scavenges free alkali metals, elevates the flame temperature, and augments low temperature ignition.

The general reaction equation is:

$$\text{metal}_1\ \text{azide} + \text{metal}_2\ \text{oxide} + \text{ammonium perchlorate} \rightarrow \text{metal}_1\ \text{oxide} + \text{metal}_1\ \text{chloride} + \text{metal}_2 + \text{nitrogen} + \text{hydrogen(trace)}$$

The specific metal oxidizers of interest are $Fe_2O_3$, $Fe_2O_3.nH_2O$, NiO (black), $Ni_2O_3$, $MnO_2$, CuO, $Co_2O_3$, $TiO_2$, and $SnO_2$. Alkali metal azide propellants containing any one or more of these metal oxides will show a burning rate enhancement when 1 to 15% ammonium perchlorate is added to the formulation. In addition to acting as a burn rate enhancer, the ammonium perchlorate is advantageous in that chlorine, oxygen, nitrogen oxide, and trace hydrogen chloride gases produced by the thermal decomposition of the ammonium perchlorate with alkali metal azide react with the free alkali metal from the thermal decomposition/oxidation-reduction of the alkali metal azide to produce alkali metal chlorides and oxides. Furthermore, the presence of ammonium perchlorate in the composition results in increased flame temperatures which yield increased nitrogen gas volume.

The prior art methods used to achieve control of burning rate and pressure-time response in azide propellants involve, respectively, varying the azide and/or oxidizer component particle size, and controlling the size, shape and thickness of the pressed pellet.

The drawbacks of these approaches to ballistic performance control is that certain practical limitations with respect to particle size and pellet configurations are quickly reached. Thus the thickness of a pellet is generally limited at the lower end by pellet strength requirements and at the upper end by fragmentation upon ignition and by size and shape requirements. Another problem frequently encountered in automotive air bag and inflator systems which employ azide propellants is the generation of undesirable amounts of free alkali metals as a combustion product. Under certain conditions this can lead to undesirable effects such as flaming and afterburning.

One of the features of the instant invention is the use of ammonium perchlorate in the propellant formulation which allows a high degree of burning rate tailorability and control over pressure-time response. This significantly lessens the ballistic performance constraints imposed on the propellant systems by component particle size and pressed pellet configuration. The use of ammonium perchlorate also lowers the free alkali metal content in the combustion residue.

A further feature of the invention is the discovery that a substantial increase in pellet strength in iron oxide propellant formulations may be obtained by using iron oxide in the form of fine sized particles.

Another feature of the instant invention is the discovery that formulations consisting of sodium azide, mixed metal oxides (such as $MnO_2$, $Fe_2O_3$, and NiO) and ammonium perchlorate exhibit a high degree of burning rate synergism and are very tailorable as to burning rate. Propellants oxidized with a mixture of $MnO_2$, $Fe_2O_3$, and NiO had faster burning rates than those oxidized with any single one of the metal oxides. Propellants oxidized with a mixture of any two of these metal oxides also showed enhanced burning rate synergism and burning rate tailorability.

According to a further feature, silicon dioxide can advantageously be included as a free sodium scavenger, slagging agent, or both, in a composition which also contains an alkali metal azide, mixed metal oxides, and ammonium perchlorate.

DETAILED DESCRIPTION OF PREFERRED EMBODIMENTS

Figure 1:
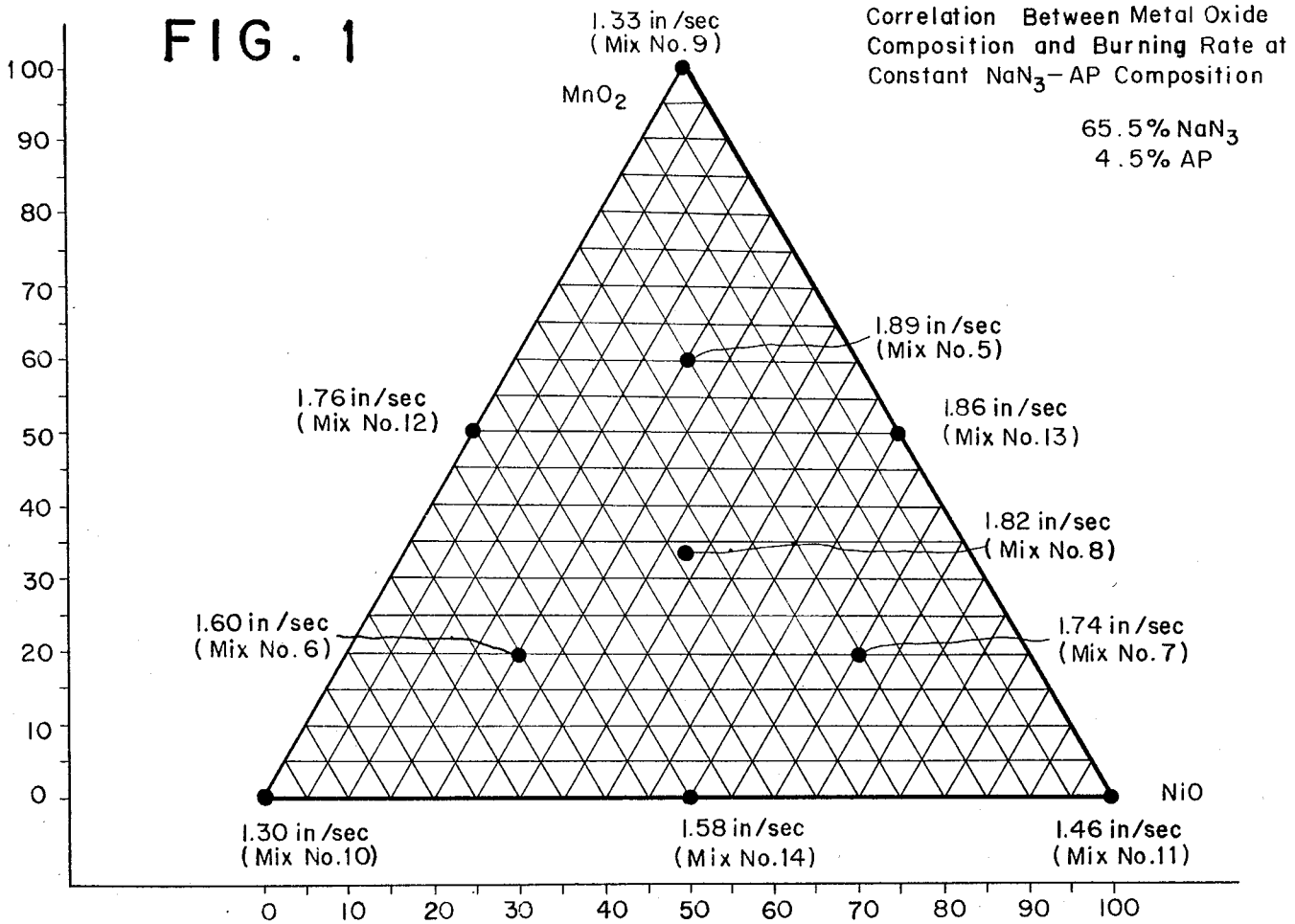
FIG. 1 is a triangle diagram showing burning rate data for various formulations (Mix Nos. 5–14) containing 65.5 weight percent sodium azide, 4.5 weight percent ammonium perchlorate, and 30.0 weight percent of various metal oxides and mixtures of metal oxides ($Fe_2O_3$, $MnO_2$, NiO), corresponding to the data in Tables I and II.

It has been found that when the composition for generating nitrogen gas free from toxic impurities comprises an alkali metal azide, at least a stoichiometric amount of a metal oxide selected from the group $Fe_2O_3$, $Fe_2O_3.H_2O$, black NiO, $Ni_2O_3$, $MnO_2$, CuO, $Co_2O_3$, $TiO_2$, and $SnO_2$ and ammonium perchlorate as a burn rate enhancer, the nitrogen gas generated is free from noxious and toxic impurities.

The principal component of the composition is the alkali metal azide. Sodium azide is preferred since it is readily available and less costly than potassium and lithium azides, which also give satisfactory results. The alkali metal azide is present as about 55 to 80 weight percent, preferably about 60 to 70 weight percent, of the composition. The second component is the metal oxide oxidizer. Suitable results can be obtained using $Fe_2O_3$, $Fe_2O_3.H_2O$, black NiO, $Ni_2O_3$, $MnO_2$, CuO, $Co_2O_3$, $TiO_2$, or $SnO_2$. The preferred oxides are CuO, $Fe_2O_3$, $MnO_2$, and NiO. The oxides are present in an amount of about 10 to 45 weight percent of the composition, preferably about 25 to 35 weight percent of the composition.

The third component of the composition is the ammonium perchlorate which is present as about 1 to 15 weight percent, preferably about 1 to 8 weight percent, of the composition. The ammonium perchlorate is the critical component of the composition in that it enhances the burn rate and provides the other advantages discussed above.

The composition is prepared by pelleting the components to reduce size requirements and to provide a maximum amount of gas from the smallest amounts of the reactants. Sodium azide, the preferred azide, is commercially available and can be used as received from the supplier. However, improved results with respect to burn rate are obtained if the sodium azide is ground to a fine powder.

The metal oxide components can be used as received from the supplier with the exception of iron oxide. Considerable difficulty was encountered in pelleting $Fe_2O_3$ as received from some suppliers. The pellets had very poor strength characteristics. It was found that if red $Fe_2O_3$ that is composed of very fine particles is used, pellets having the desired strength can be prepared. The preferred red $Fe_2O_3$ is available from BASF Wyandotte Corp. under the tradename SICOTRANS 2715.

The ammonium perchlorate can be used as received from the supplier. However, improved results are obtained if the ammonium perchlorate is triple ground (6 to 11 microns average particle size).

The next step in the preparation of the composition is the thorough mixing of the components. Satisfactory results are obtained if the components are mixed in a commercially available V-blender.

In the final step the blended composition is pressed into pellets using standard pressing techniques and equipment.

When the techniques described above are used, pellets having a break strength of greater than 18 pounds can be prepared.

Another significant feature of the invention resides in the system comprising sodium azide, mixed metal oxides (such as $MnO_2$, $Fe_2O_3$, and NiO), and ammonium perchlorate. When pellets prepared from this composition were tested it was found that the heats of reaction increased with ammonium perchlorate content. This generally results in higher flame and exit gas temperatures which in turn produces increased gas pressure and gas volume. This effect would ultimately allow for the use of less propellant mass to prepare the desired quantity of nitrogen gas.

To test for the presence of free sodium, water is added to the combustion residues. It is found that the free-sodium/water reaction decreases in intensity with increased ammonium perchlorate content. Thus, increased ammonium perchlorate content reduces the potential for post-ignition or flaming problems.

In addition, pressed pellet densities increased with increased NiO content. This is important since it is obvious that the denser the pressed pellet the more volume efficient it is. As pointed out above, the break strength of the pellet increased with increased red $Fe_2O_3$ (SICOTRANS) content. The use of SICOTRANS 2715 in selected systems will provide a degree of pellet strength tailoring.

Since the burning rate increased with increased ammonium perchlorate content adjusting the ammonium perchlorate level allows one to tailor burning rates.

The invention is illustrated by the following specific but non-limiting examples.

EXAMPLE I

A composition was prepared by thoroughly mixing 65.0 weight percent sodium azide having a particle size of 20 to 120 microns, 30.0 weight percent of red iron oxide (SICOTRANS 2715) and 5.0 weight percent triple ground ammonium perchlorate. The mixture was pelleted using the techniques described above.

EXAMPLE II

A mixture composed of 64.0 weight percent sodium azide, 32.0 weight percent black nickel oxide and 4.0 weight percent triple ground ammonium perchlorate was prepared using the general techniques described in Example I above.

EXAMPLE III

A composition containing 70 weight percent sodium azide, 24 weight percent manganese dioxide and 6 weight percent ammonium perchlorate was prepared using the general technique described in Example I above.

EXAMPLE IV

A mixture composed of 65.5 weight percent sodium azide, 30 weight percent cobalt oxide ($Co_2O_3$) and 4.5 weight percent ammonium perchlorate was prepared using the general technique described above.

These compositions have been found to have high stability to shock and to electrostatic forces, a high heat of reaction and a favorable gas yield.

EXAMPLE V

The effects of sodium azide, metal oxide, and ammonium perchlorate content were tested in a series of eight mixes composed of 65.5 or 67 percent by weight sodium azide having an average particle size of 20 to 35 microns, varying amounts of a mixture of $MnO_2$, red $Fe_2O_3$ (SICOTRANS 2715), and NiO, and 3 and 4.5 weight percent ammonium perchlorate. The compositions were pressed into 0.375-inch diameter by one inch long pellets for ballistic testing and into 0.800 inch diameter by 0.140 inch thick tablets for chemical and physical property determination. The results are set out in Table I below. The compositions had heats of reaction from 361 to 430 calories per gram. It is apparent that the heat of reaction improved considerably by increasing the ammonium perchlorate concentration from 3 to 4.5 weight percent.

TABLE I

Results of Chemical, Physical, and Ballistics Testing on AP-Catalyzed Nitrogen Gas Generating Compositions

| Mix No. | Weight Percent Composition $NaN_3$ *(fine) | $MnO_2$ | $Fe_2O_3$ | NiO | **AP | Heat of Reaction cal/g | Break Strength lbs. | Burning Rate at 1000 psi, in/sec | Pressure Exponent *** (slope n) |
|---|---|---|---|---|---|---|---|---|---|
| 1 | 67.0 | 18.0 | 6.0 | 6.0 | 3.0 | 392 | 10.4 | 1.80 | 0.31 |
| 2 | 67.0 | 6.0 | 18.0 | 6.0 | 3.0 | 363 | 14.8 | 1.36 | 0.28 |
| 3 | 67.0 | 6.0 | 6.0 | 18.0 | 3.0 | 361 | 13.1 | 1.54 | 0.30 |
| 4 | 67.0 | 10.0 | 10.0 | 10.0 | 3.0 | 397 | 13.2 | 1.47 | 0.32 |
| 5 | 65.5 | 18.0 | 6.0 | 6.0 | 4.5 | 430 | 12.1 | 1.89 | 0.27 |
| 6 | 65.5 | 6.0 | 18.0 | 6.0 | 4.5 | 410 | 14.0 | 1.60 | 0.25 |
| 7 | 65.5 | 6.0 | 6.0 | 18.0 | 4.5 | 423 | 11.2 | 1.74 | 0.29 |
| 8 | 65.5 | 10.0 | 10.0 | 10.0 | 4.5 | 423 | 13.6 | 1.82 | 0.25 |

*20 to 35 micron average particle size

**ammonium perchlorate (triple ground)

***The pressure exponent in Tables I and II is the exponent n in the equation $r_b = KP^n$ where $r_b$ is the burning rate, K is the proportionality constant, and P is the pressure.

EXAMPLE VI

Further testing of the effects of metal oxide content was performed in a series of six mixes containing 65.5 weight percent fine sodium azide, 4.5 weight percent triple ground ammonium perchlorate, and varying amounts (0 to 30.0 wt. %) of $MnO_2$, red $Fe_2O_3$ (SICOTRANS 2715), and black NiO. The compositions were prepared by the same techniques as in Example VI. The results are set out below in Table II.

TABLE II

Results of Chemical, Physical, and Ballistics Testing on AP-Catalyzed Nitrogen Gas Generating Compositions

| Mix No. | Weight Percent Composition $NaN_3$ (fine) | $MnO_2$ | $Fe_2O_3$ | NiO | AP | Heat of Reaction cal/g | Break Strength lbs. | Burning Rate at 1000 psi, in/sec | Pressure Exponent (slope n) |
|---|---|---|---|---|---|---|---|---|---|
| 9 | 65.5 | 30.0 | | | 4.5 | 387 | 7.8 | 1.33 | 0.29 |
| 10 | 65.5 | | 30.0 | | 4.5 | 410 | 14.8 | 1.30 | 0.25 |
| 11 | 65.5 | | | 30.0 | 4.5 | 456 | 7.8 | 1.46 | 0.33 |
| 12 | 65.5 | 15.0 | 15.0 | | 4.5 | 443 | 13.6 | 1.76 | 0.28 |
| 13 | 65.5 | 15.0 | | 15.0 | 4.5 | 430 | 7.7 | 1.86 | 0.25 |
| 14 | 65.5 | | 15.0 | 15.0 | 4.5 | 411 | 14.1 | 1.58 | 0.33 |

The above compositions show the synergistic effect of mixed oxides on burning rate. Also seen is the enhanced break strength due to the presence of red $Fe_2O_3$ (SICOTRANS 2715).

FIG. 1 illustrates the burning rate synergism of sodium azide—mixed metal oxide—ammonium perchlorate systems. The points plotted in FIG. 1 represent the burning rates of Mix Nos. 5–14 in Tables I and II. All mixes had 65.5 weight percent of $NaN_3$ and 4.5 weight percent of ammonium perchlorate, plus 30.0 weight percent of a single metal oxide or a mixture of two or three metal oxides. The increase in burning rate toward the center of the diagram is evident. That is, higher burning rates were obtained for formulations containing oxide mixtures than for formulations containing only one metal oxide. One could easily interpolate an equal burning rate contour fitted approximately to Mix Nos. 5, 8, and 13; a second fitted to Mix Nos. 7 and 12; and a third fitted to Mix Nos. 6 and 14.

EXAMPLE VII

Formulations which incorporated advantageous auxiliary ingredients, such as Sulfur as a Na° scavenger and $SiO_2$ as a Na° scavenger and $Na_2O$ slagging agent, were also investigated. The following formulations had very fast burning rates:

TABLE III

Results of Chemical, Physical, and Ballistics Testing on AP-Catalyzed Nitrogen Gas Generating Compositions which Incorporate $SiO_2$ and Sulfur

| Mix No. | Weight Percent Composition $NaN_3$ (fine) | $MnO_2$ (activated) | $SiO_2$ (silica flour) | S | AP | Heat of Reaction cal/g | Break Strength lbs. | Burning Rate at 1000 psi, in/sec | Pressure Exponent (slope n) |
|---|---|---|---|---|---|---|---|---|---|
| 15 | 66.0 | 18.0 | 11.0 | 4.0 | 5.0 | 549.5 | 15.0 | 1.94 | 0.37 |
| 16 | 70.0 | 19.0 | | | 7.0 | 543.4 | 16.2 | 1.92 | 0.20 |

These propellants were insensitive to friction and electrostatic discharge, and were moderately sensitive to impact. The break strengths and burning rates were high, while the slopes were relatively low.

EXAMPLE VIII

Two formulations were selected for testing in gas cushion inflator hardware. These are set out in Table IV below.

TABLE IV

Results of Chemical, Physical, and Ballistics Testing on AP-Catalyzed Nitrogen Gas Generating Compositions

| Mix No. | Weight Percent Composition $NaN_3$ (fine) | $Fe_2O_3$ | NiO | AP | Heat of Reaction cal/g | Break Strength lbs. | Burning Rate at 1000 psi, in/sec | Pressure Exponent (slope n) |
|---|---|---|---|---|---|---|---|---|
| 17 | 65.6 | 29.9 | | 4.5 | 433.0 | 21.0 | 1.13 | 0.41 |
| 18 | 63.5 | | 32.0 | 4.5 | 457.7 | 14.6 | 1.27 | 0.26 |

These formulations were prepared as 1500.0 gram mixes, slugged, granulated, and pressed into pellets about 0.800 inches in diameter by 0.140 inches thick. About 75.0 to 84.0 grams of propellant (40 pellets) were loaded into each gas cushion inflator unit. The results of tank firings were very good, as seen below in Table V.

TABLE V

Results of Gas Cushion Inflator Testing (Tank Firings) with AP-Catalyzed Nitrogen Gas Generating Propellants

| Mix No. | Mass of Pellets g | Firing Temp. °F. | Max. Combustor Pressure Kpa (psi) | Time to Max Press. msec | Max. Tank Press Kpa (psi) | Time to Max. Tank Pressure msec |
|---|---|---|---|---|---|---|
| 17 | 75.94 | 77 | 15296 (2219) | 6.4 | 287 (41.6) | 50.4 |
| | 75.93 | 77 | 15406 (2234) | 5.6 | 284 (41.2) | 49.6 |
| | 75.95 | −20 | 11469 (1663) | 5.6 | 240 (34.8) | 61.6 |
| | 75.83 | 180 | 21982 (3175) | 3.2 | 279 (40.5) | 26.4 |
| 18 | 83.51 | 77 | 16699 (2422) | 6.4 | 303 (44.0) | 36.8 |
| | 83.54 | 77 | 16354 (2372) | 4.8 | 302 (43.9) | 56.8 |
| | 83.49 | −20 | 12460 (1807) | 5.6 | 241 (35.0) | 68.8 |

TABLE VI

Results of Chemical, Physical, and Ballistics Testing on AP-Modified CuO—Oxidixed Nitrogen Gas Generating Propellants

| Mix No. | Weight Percent Composition $NaN_3$ (coarse) | CuO | AP (3x) | Heat of Reaction cal/g | $Na^{\circ}$—$H_2O$ Reaction *** | Break Strength lbs. | Hydro-static Density g/cc | Burning Rate at 1000 psi, in/sec | Pressure Exponent (slope n) |
|---|---|---|---|---|---|---|---|---|---|
| 19 | 61.0 | 39.0 | — | 379.9 | 2 | 13.9 | 2.36 | 1.48 | 0.19 |
| 20 | 61.0 | 37.5 | 1.5 | 413.7 | 2 | 12.2 | 2.34 | 1.80 | 0.19 |
| 21 | 61.0 | 36.0 | 3.0 | 462.3 | 1 | 12.8 | 2.31 | 1.97 | 0.20 |
| 22 | 61.0 | 34.5 | 4.5 | 487.8 | 0 | 13.2 | 2.30 | 2.24 | 0.21 |
| 23 | 61.0 | 33.0 | 6.0 | 520.4 | 1 | 13.1 | 2.27 | 2.37 | 0.32 |
| 24 | 61.0 | 31.5 | 7.5 | 555.8 | 0 | 12.9 | 2.24 | 2.42 | 0.28 |

***Intensity of free-$Na^{\circ}$/water reaction:
0 - none
1 - very low
2 - low
3 - moderate
4 - high
5 - very high

EXAMPLE IX

Table VI shows a series of sodium azide propellants containing 61.0 weight percent of coarse $NaN_3$, and varying amounts of cupric oxide (CuO) and triple ground ammonium perchlorate (AP) prepared according to the general technique described above.

As AP content increased from 0 to 7.5 weight percent, heats of reaction and burning rates increased; while the free sodium content (intensity of the freesodium/water reaction) and pressed pellet densities decreased. Pellet break strengths were relatively constant. Resistance to shock and also gas yield were both high. It is believed that the AP in these propellants augments low temperature ignition. Theoretically the flame temperatures increase with increasing AP content. This produces an increasingly hotter gas, thus requiring less gas, and thus less propellant, to fill a given volume. Further, increased AP should also enhance the scavenging of free $Na^{\circ}$, resulting in an increase in NaCl as an exit component and reducing the potential for flaming.

Obviously many modifications and variations of the invention may be made without departing from the essence and scope thereof and only such limitations as are indicated in the appended claims should be implied.

What is claimed is:

1. A solid composition for generating nitrogen gas free from noxious and toxic impurities consisting essentially of a mixture of (a) an alkali metal azide;

(b) a primary oxidizer consisting essentially of at least a stoichiometric amount of a metal oxide containing sufficient available oxygen to substantially fully oxidize the alkali metal of the azide, said metal oxide being selected from the group consisting of oxides of iron, nickel, manganese, copper, cobalt, titanium, and tin; and (c) an ammonium perchlorate burn rate enhancer for enhancing the burn rate of the mixture of said alkali metal azide and said primary oxidizer and present as about 1 to 15 weight percent of the composition.

2. The composition according to claim 1 wherein the azide is sodium azide.

3. The composition according to claim 1 wherein the alkali metal azide is sodium azide and is present as about 55 to 80 weight percent of the composition, the metal oxide is present as about 10 to 45 weight percent of the composition, and the ammonium perchlorate burn rate enhancer is present as about 1 to 15 weight percent of the composition.

4. The composition according to claim 1 wherein the alkali metal azide is sodium azide and is present as about 60 to 70 weight percent of the composition, the metal oxide is present as about 25 to 40 weight percent of the composition and the ammonium perchlorate burn rate enhancer is present as about 1 to 8 weight percent of the composition.

5. The composition according to claim 4 wherein sodium azide is present as about 65 weight percent of the composition, the oxide is $Fe_2O_3$ present as about 30 weight percent of the composition and the ammonium perchlorate burn rate enhancer is present as about 5 weight percent of the composition.

6. The composition according to claim 5 wherein the $Fe_2O_3$ is made up on fine sized particles.

7. The composition according to claim 4 wherein the sodium azide is present as about 64 weight percent of the composition, the oxide is nickel oxide present as about 32 weight percent of the composition and the ammonium perchlorate burn rate enhancer is present as about 4 weight percent of the composition.

8. The composition according to claim 4 wherein the sodium azide is present as about 61 weight percent of the composition, the oxide is CuO present as about 30 to 40 weight percent of the composition and the ammonium perchlorate burn rate enhancer is present as about 1 to 8 weight percent of the composition.

9. The composition according to claim 4 wherein the sodium azide is present as about 65 to 66 weight percent of the composition, the oxide is $Co_2O_3$ present as about 30 weight percent of the composition and the ammonium perchlorate burn rate enhancer is present as about 4 to 5 weight percent of the composition.

10. The composition according to claim 4 wherein the sodium azide is present as about 70 weight percent of the composition, the oxide is activated $MnO_2$ present as about 24 weight percent of the composition and the ammonium perchlorate burn rate enhancer is present as about 6 weight percent of the composition.

11. A solid composition for generating nitrogen gas free from noxious and toxic impurities consisting essentially of a mixture of (a) an alkali metal azide;

(b) a primary oxidizer consisting essentially of at least a stoichiometric amount of a mixture of $MnO_2$, $Fe_2O_3$, and NiO, said primary oxidizer containing sufficient available oxygen to substantially fully oxidize the alkali metal of the azide, and (c) an ammonium perchlorate burn rate enhancer for enhancing the burn rate of the mixture of said alkali metal azide and said primary oxidizer and present as about 1 to 15 weight percent of the composition.

12. The composition according to claim 11 wherein the azide is sodium azide.

13. The composition according to claim 12 wherein the sodium azide is present as about 60 to 70 weight percent of the composition, the mixture of $MnO_2$, $Fe_2O_3$ and NiO is present as about 25 to 35 weight percent of the composition and the ammonium perchlorate is present as about 3 to 5 percent by weight.

14. The composition according to claim 13 wherein the $MnO_2$, $Fe_2O_3$ and NiO components of the mixture are each present as about 10 weight percent of the composition.

15. The composition according to claim 12 wherein the $Fe_2O_3$ component of the mixture is made up of fine sized particles, present as about 6 to 18 percent by weight.

16. The composition according to claim 12 wherein the $MnO_2$ component of the mixture is present as about 6 to 18 weight percent.

17. The composition according to claim 12 wherein the NiO component of the mixture is present as about 6 to 18 weight percent.

18. The composition according to claim 12 wherein the $MnO_2$, NiO and $Fe_2O_3$ components of the mixture are each present as about 10 weight percent of the mixture.

19. A solid composition for generating nitrogen gas free from noxious and toxic impurities consisting essentially of a mixture of (a) an alkali metal azide;

(b) a primary oxidizer consisting essentially of at least a mixture of two metal oxides, said primary oxidizer containing sufficient available oxygen to substantially fully oxidize the alkali metal of the azide, and (c) an ammonium perchlorate burn rate enhancer for enhancing the burn rate of the mixture of said alkali metal azide and said primary oxidizer and present as about 1 to 15 weight percent of the composition.

20. The composition according to claim 19 wherein the azide is sodium azide.

21. The composition according to claim 20 wherein the sodium azide is present as about 60 to 70 weight percent of the composition, the mixture of oxides is present as about 25 to 35 weight percent of the composition, and the ammonium perchlorate is present as about 3 to 5 percent by weight.

22. The composition according to claim 21 wherein the two oxide components of the mixture are each present as about 15 percent by weight.

23. The composition according to claim 19 wherein the two metal oxides are selected from the group consisting of $MnO_2$, $Fe_2O_3$ and NiO.

24. The composition according to claim 23 wherein the $Fe_2O_3$ component of the mixture is made up of fine sized particles, present as about 12 to 18 percent by weight.

25. The composition according to claim 23 wherein the $MnO_2$ component of the mixture is present as about 12 to 18 percent by weight.

26. The composition according to claim 23 wherein the NiO component of the mixture is present as about 12 to 18 percent by weight.

27. The composition according to claim 20 wherein the two oxide components of the mixture are each present as about 15 percent by weight.

* * * * *

UNITED STATES PATENT AND TRADEMARK OFFICE

CERTIFICATE OF CORRECTION

PATENT NO. : 4,604,151

DATED : August 5, 1986

INVENTOR(S) : Gregory D. Knowlton and John F. Pietz

It is certified that error appears in the above-identified patent and that said Letters Patent is hereby corrected as shown below:

In drawing FIG. 1, the lower left corner of the triangle diagram should be labeled as -- $Fe_2O_3$ --.

Signed and Sealed this

Sixth Day of September, 1988

*Attest:*

DONALD J. QUIGG

*Attesting Officer*

*Commissioner of Patents and Trademarks*